US005196146A

United States Patent [19]

Farella et al.

[11] Patent Number: 5,196,146

[45] Date of Patent: Mar. 23, 1993

[54] AQUEOUS CLEANING FORMULATION CONTAINING A 2-PIPERAZINONE, METHOD OF USING THE SAME AND CONCENTRATE FOR PREPARING THE SAME

[75] Inventors: Joanna M. Farella, Midland, Mich.; Dane Chang, Houston, Tex.; Felipe A. Donate, Midland, Mich.; Aubrey J. Rhymes, Jr., Lake Jackson, Tex.

[73] Assignee: The Dow Chemical Company, Midland, Mich.

[21] Appl. No.: 784,203

[22] Filed: Oct. 28, 1991

[51] Int. Cl.[5] ..... C11D 3/28

[52] U.S. Cl. ..... 252/542; 252/394; 134/40

[58] Field of Search ..... 252/542, 394; 134/40

[56] References Cited

U.S. PATENT DOCUMENTS 4,367,169 1/1983 Matsushita et al. ..... 252/542

FOREIGN PATENT DOCUMENTS 2124833 12/1972 Fed. Rep. of Germany ..... 252/542

2180846 4/1987 United Kingdom ..... 252/542

*Primary Examiner*—Asok Pal

[57] ABSTRACT

An aqueous formulation for cleaning grease and oil from metal, plastic, glass or other surfaces includes water, a surfactant, and a corrosion-inhibiting amount of a 2-piperazinone. The surfactant is chosen from the class of materials possessing at least some ability in aqueous solution to disperse the grease and oil in an aqueous suspension. The formulation preferably includes both an anionic and a nonionic surfactant. The 2-piperazinone inhibits corrosion of the metal or other surface without unduly reducing the dispersive ability of the surfactant(s). The preferred 2-piperazinones for use in the disclosed invention are 4-(2-hydroxyethyl)-2-piperazinone (4-HEP) and N,N-dimethyl-2-piperazinone (NNDP). The formulation is used by agitation in contact with the surface to be cleaned, for example, by mechanical agitation of the surface, by spraying the formulation against the surface, or by the application of ultrasound waves. A concentrate for preparing the formulation contains the surfactant(s) and 2-piperazinone at a concentration 5 to 20 times their concentrations in the formulation; the concentrate is then diluted with 5 to 20 parts of water to yield the formulation.

35 Claims, No Drawings

AQUEOUS CLEANING FORMULATION CONTAINING A 2-PIPERAZINONE, METHOD OF USING THE SAME AND CONCENTRATE FOR PREPARING THE SAME

TECHNICAL FIELD

This invention relates generally to the cleaning of metal, plastic, glass or other bare or finished surfaces, and more particularly to the cleaning of tenacious greases and oils from these surfaces.

BACKGROUND OF THE INVENTION

Contamination of the surface of a metal, plastic, glass or other bare or finished part can arise from several sources. The surface may be exposed to soils from the environment in which it is located or used. Greases, oils and heavy-metal soaps are often applied to parts as lubricants to facilitate fabrication processes such as stamping, drawing, machining or annealing. Once a part is formed it may be stored for some period before it is used, or before its surface is treated. For example, metal surfaces usually require cleaning before phosphatizing, chromatizing or coating (such as painting or plating). Because unprotected metal surfaces may oxidize or tarnish over time, a stored metal part is sometimes coated with a protective oil to prevent surface oxidation or tarnish during storage.

Any such contaminants which remain on a surface prior to treatment of the surface can interfere with that treatment, for example, by preventing good adhesion of a coating to the surface. Accordingly, it is highly desirable that dirt, lubricants, metal oxides, rust, organic residues and protective oils be removed from surfaces before they are coated or painted.

While prior compositions fo. performing any one of these cleaning functions have been useful for their intended purposes, their use has been subject to some drawbacks. For example, oil, grease, rust or metal oxides can be cleaned from many metal surfaces by pickling. Pickling involves the application of a relatively concentrated solution of an acid (typically at least 15 percent concentration) such as hydrochloric acid, sulfuric acid, or phosphoric acid to the metal surface. Even though this will clean the metal oxide or rust from the metal surface, such solutions can corrode the metal surface itself. Moreover, due to the concentration of the acid solutions, the handling of pickling solutions requires a significant degree of care. Pickling solutions can corrode flesh, rubber hosing, pumps or concrete coming in contact with the solutions. There may also be significant environmental limitations on the disposal of pickling waste, due to its high acidity.

Abrading has also been employed to remove contaminants from the surface of a part. However, abrading typically entails an appreciable loss of material from the surface, and can result in unacceptable damage to the surface of the part, especially a part having a surface finish on it.

Different problems are encountered in other methods of removing oil and grease. Organic solvents have been successfully employed to remove grease and oil from metal and glass surfaces. However, the use of an organic solvent may pose a fire hazard, particularly if the solvent is deposited upon the metal surface from the vapor phase. Moreover, although the solvents used for cleaning are often recycled, they eventually must be disposed of, and the cost of disposal may not be inconsequential. Of course, organic solvents can attack many plastic surfaces and many surface coatings or finishes.

For purposes of cost and safety, it would be desirable to use aqueous solutions for surface cleaning. Concentrated solutions of strong alkalis have been used for degreasing, but their use has been subject to some drawbacks. Degreasing with strong alkalis may not be complete, while the use of strong alkalis (like the use of acid pickling solutions) can entail significant safety risks and environmental effects. Strong alkalis may also attack some glass and plastic surfaces, and some finishes. Accordingly, relatively neutral aqueous cleaners would be desirable.

Surface active agents (surfactants) such as detergents and wetting agents are known to be generally useful in dispersing grease and oil into aqueous suspension. Soaps (for example, the sodium or other light metal salts of fatty acids) and synthetic surfactants (cationic, nonionic and anionic surfactants) are commonly used for that purpose, either alone, or in combination with other materials. Surfactants are advantageous because they are usually less hazardous to use than other cleaning materials, and are often less costly than other materials to prepare, use or dispose of.

The use of surfactants in cleaning, in particular, the use of anionic surfactants, is subject to some drawbacks. Some solutions of these materials have a low enough pH or a sufficiently great ionic activity to corrode metal surfaces to which they are applied. The amount of dirt or other contaminants entrained in the oil or grease on a surface may affect the hardness of the cleaning solution applied to the surface, and thus affect the ability of the surfactant to clean the surface. Of course, the dispersant activity of a particular surfactant often varies with the type of grease or oil to be cleaned. Indeed, because many greases and oils are intended to be water-resistant, the use of an aqueous solution to clean many greases and oils is not common.

For example, Conoco Inc., Houston, Texas, sells a high temperature, corrosion-resistant grease under the name "HD Calcium Grease". HD Calcium Grease is a gelled hydrocarbon oil, containing calcium carbonate and calcium sulfate as gelling agents, as well as sodium nitride and zinc naphthenate as rust inhibitors, and an oxidation inhibitor. The product is formulated for use in salt water, fresh water or corrosive fluids, and has high water resistance and good rust inhibition. It is Applicants' understanding that it is the belief of Conoco that the HD Calcium Grease cannot be adequately cleaned from a metal surface with an aqueous cleaner.

Similarly, Witco Corp., Houston, Texas, sells a particular grease under the name "Prestige 741 AEP". The grease is made by Sun Chemical Corporation, Chester, South Carolina (product code #319451). The material is a reaction product of lithium 12-hydroxy stearate with Sun's 700 SSU base oil. The 700 SU base oil is primarily a mixture of more than 65 percent straight chain hydrocarbons, with the balance being naphthenic type hydrocarbons, with few aromatics and no significant additives. It is Applicants' understanding that aqueous cleaners are not recommended by Witco for removal of this grease from metal surfaces.

These greases are just two examples of the many greases and oils which are designed to resist dispersal in water. Of course, no surfactant is useful against all greases and oils, and certain greases and oils more tenaciously resist dispersal than others. While aqueous surfactants are intended to overcome the reluctance of hydrophobic greases to disperse, those surfactants most effective in dispersing the more tenacious oils and greases are unfortunately sometimes more likely to corrode the metal surface to which they are applied, precisely because they leave a cleaner surface than do less effective surfactants. The cleaner and thus less protected surface is more likely to be attacked by anything in the cleaning solution still in contact with the surface.

Corrosion inhibitors have been used in compositions having a purpose unrelated to cleaning grease and oil from metal surfaces, for example, in compositions useful for removing calcium and magnesium scale (insoluble deposits) or rust from metal equipment such as boilers or the like. One example is disclosed in U.S. Pat. No. 4,637,899 (Kennedy, Jr., Jan. 20, 1987), which employs an inhibitor comprising a sulfur-containing compound and at least one of an aliphatic pyridinium salt or an aliphatic quinolinium salt. A small but corrosion-inhibiting amount of this inhibitor is added to an aqueous solution of an organic acid or organic acid salt.

The property of acid corrosion inhibition has been attributed to 4-(2-hydroxyethyl)-2-piperazinone, in U.S. Pat. No. 4,814,443 (and its divisional U.S. Pat. No. 4,880,934), issued Mar. 21, 1989, to Dwayne S. Treybig and John M. Motes, assigned to the assignee of the present application. The specification of the patent is directed to processes for preparing this and similar materials from reacting hydroxyalkyl alkaline diamines with glyoxal. The specification notes the utility of the compound as a regenerative solvent for the desulfurization of flue gas, and as a binder between asphalt and fiberglass or a rock aggregate. There is no discussion, however, of the circumstances under which the material is operative to inhibit corrosion, nor of any compositions with which the material is compatible. Nor does the specification disclose or suggest how or whether the material might affect the utility of any composition to which it would be added.

It is therefore an object of the present invention to provide an improved, non-corrosive aqueous solution for cleaning grease and oil from a metal, plastic or glass surface.

It is another object of the present invention to avoid the need to use a concentrated acid, a concentrated alkali, or a hydrocarbon solvent to fully clean grease and oil from a metal, plastic or glass surface.

It is a further object of the present invention to provide a method to clean grease and oil from finished surfaces without damaging the finish on those surfaces.

SUMMARY OF THE INVENTION

In accordance with the preferred embodiment of the invention, these and other objects and advantages are addressed as follows:

The present invention provides an aqueous cleaning formulation for removing grease and oil from a bare or finished metal, plastic, glass or other surface which adequately cleans a variety of tenacious greases from the surface while substantially preventing corrosion of the surface during cleaning. More particularly, Applicants have discovered that the corrosiveness of aqueous surfactant solutions can be significantly decreased, generally without deterioration of their effectiveness to disperse grease and oil, by the addition of an N-substituted- or N,N-disubstituted-2-piperazinone. This lack of deterioration is unexpected. The addition of a 2-piperazinone to an aqueous surfactant solution may also make the solution less subject to weakening of its cleaning power by water hardness. The hardness of the water employed in a formulation according to the present invention appears to have very little effect upon the performance of the cleaning formulation.

Thus, in a first aspect, the present invention is directed to an aqueous cleaning formulation for removing grease and oil from a surface, comprising water, a surfactant possessing at least some ability to disperse the grease and oil in aqueous suspension, and a corrosion-inhibiting amount of a 2-piperazinone of the formula

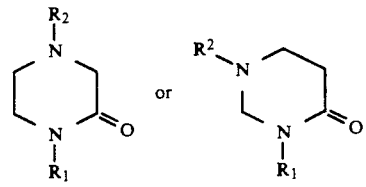

wherein $R_1$ and $R_2$ are chosen from the class consisting of H and straight-chain alkanes, alkanols and ethers containing from 1 to 14 carbons, such that $R_1$ and $R_2$ are not both H. 4-(2-hydroxyethyl)-2-piperazinone (4-HEP) and N,N-dimethyl-2-piperazinone (NNDP) are particularly preferred 2-piperazinones.

Applicants intend "2-piperazinone" to mean both isomers even though the name is strictly the common name for only the first isomer. Applicants are not aware of a recognized common name for the second isomer.

The 2-piperazinone can be employed in conjunction with a number of different nonionic and anionic surfactant aqueous solutions, and is preferably employed in conjunction with a mixture including both an anionic and a nonionic surfactant. Useful surfactants in the present invention include alkylated diphenyl oxide sulfonate surfactants (as acids, or sodium, calcium, potassium or ammonium salts, or mixtures thereof), and alcohol alkoxylates, such as ethoxylates, propoxylates, butoxylates, ethoxybutoxylates and propoxybutoxylates. Operative embodiments of the formulation of the present invention can generally include 0.8 to 50 percent of the 2-piperazinone, 0.05 to 10 percent of an anionic surfactant, 0.05 to 10 percent of a nonionic surfactant, and 20 to 80 percent (balance) water. (These and all other recited percentages are by weight, unless expressly stated otherwise.) Preferred embodiments can generally include 1 to 10 percent of a conventional detergency builder, 1 to 4 percent 1,2-octanediol (to improve the effectiveness of the surfactant against lithium greases), or 0.01 to 2 percent of an antifoaming agent.

In a second aspect, the present invention is directed to a method of removing oil and grease from a surface, comprising exposing the surface to such an aqueous cleaning formulation, for a time and at a temperature sufficient to remove enough of the oil and grease from the surface to permit subsequent processing of the surface. Those skilled in the art can readily recognize when a particular surface is clean enough to allow successful performance of further processing steps such as painting, plating, chromating, phosphatizing, or the like. The method is preferably carried out at a temperature of 25°-90° C., for a time appropriate to the method of exposure. Methods of exposure include mechanical agitation of the part while submersed in the formulation (for example, in a conventional shaker bath), jet spraying of the part surface with the formulation, and the application of ultrasound waves to the part while the part is submersed in the formulation. Ultrasound exposure times can typically be expected to be on the order of 30 seconds.

In a third aspect, the present invention is directed to concentrates useful for making such an aqueous cleaning formulation, upon admixture of one part by weight of the concentrate in 5 to 20 parts by weight of water. One preferred concentrate comprises about 12 to 20 parts (preferably about 12 parts) by weight 4-(2-hydroxyethyl)-2-piperazinone; about 5 to 7.5 parts (preferably about 6.25 parts) by weight of the sodium salt of an alkylated diphenyl oxide sulfonate surfactant; about 2.5 to 37.5 parts by weight of a nonionic surfactant including ethoxylated and propoxylated primary $C_8$–$C_{10}$ alcohols, or $C_9$–$C_{11}$ linear primary alcohol ethoxylates; and water in an amount sufficient for suspension of these. Preferably, this first concentrate further comprises about 0.2 parts by weight of an antifoaming agent.

A second preferred concentrate comprises about 12 parts by weight 4-(2-hydroxyethyl)-2-piperazinone; about 5 to 7.5 parts (preferably about 6.25 parts) by weight of the acid of an alkylated diphenyl oxide sulfonate surfactant; about 2.5 to 37.5 parts by weight of a nonionic surfactant including ethoxylated and propoxylated primary $C_8$–$C_{10}$ alcohols, or $C_9$–$C_{11}$ linear primary alcohol ethoxylates; and water in an amount sufficient for suspension of these. Preferably, this second concentrate further comprises about 0.2 parts by weight of an antifoaming agent.

A third preferred concentrate comprises about 6 parts by weight 4-(2-hydroxyethyl)-2-piperazinone; about 2.5 to 3.75 parts (preferably about 3.125 parts) by weight of the acid of an alkylated diphenyl oxide sulfonate surfactant; about 1.25 to 18.75 parts by weight of a nonionic surfactant including ethoxylated and propoxylated primary $C_8$–$C_{10}$ alcohols, or $C_9$–$C_{11}$ linear primary alcohol ethoxylates; and water in an amount sufficient for suspension of these. Preferably, this third concentrate further comprises about 0.1 part by weight of an antifoaming agent.

The disclosed formulations and concentrates are useful both in the presence of, and in the absence of, other materials. Accordingly, formulations and concentrates either comprising, consisting essentially of or consisting of the combinations of constituents in the various aspects of the invention are all useful in the practice of the present invention.

DETAILED DESCRIPTION OF THE INVENTION

The 2-piperazinones are useful corrosion inhibitors in aqueous solutions including a wide range of surfactants, such as light metal soaps, detergents, and synthetic surfactants having a wide variance in molecular weight. Preferably, the present invention includes at least one of an anionic surfactant and a nonionic surfactant. It is particularly preferred that the cleaning formulation of the present invention includes both an anionic and a nonionic surfactant. Whatever surfactant is included, however, it must have some dispersive activity against the grease or oil to be removed, and should have a greater dispersive activity than does pure water under similar conditions of time, temperature and agitation during cleaning.

A cleaning formulation according to the present invention contains an operative range of the surfactant from 0.1 to 20 percent, and a preferred range from 0.5 to 10 percent, in aqueous solution. When both an anionic and a nonionic surfactant are employed, the formulation possesses an operative range of 0.05 to 10 percent of each of the anionic and nonionic surfactants, a preferred range of 0.25 to 5 percent each, and a particularly preferred range of 0.25 to 2 percent of the anionic surfactant and 0.25 to percent of the nonionic surfactant. The different surfactants need not be present in the same amount, however. Each of the anionic and nonionic surfactants can be included as single materials, although more conveniently the surfactants are used in the form of commercial solutions or compositions containing them.

Particularly preferred for use as anionic surfactants in the present invention are the alkylated diphenyl oxide sulfonate surfactants. The alkylated diphenyl oxide sulfonate surfactants correspond to the following formula or to a mixture of compounds corresponding to the following formula:

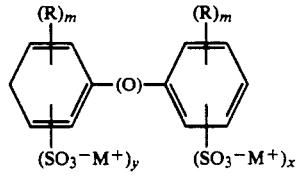

wherein each R is independently a saturated alkyl or substituted saturated alkyl radical or an unsaturated alkyl or substituted unsaturated alkyl radical; each m and n is independently 0,1 or 2; each M is independently hydrogen, an alkali metal, an alkaline earth metal, or ammonium or substituted ammonium; and each x and y are individually 0 or 1 Preferably, each R group is independently an alkyl group having from about 8 to about 24 carbon atoms, even more preferably about 10 to about 20 carbon atoms, and most preferably about 12 to about 16 carbon atoms, with 16 carbon atoms being especially preferred. The alkyl groups can be linear, branched or cyclic, with linear or branched radicals being preferred. The $M^+$ ammonium ion radicals are of the formula $(R')_3NH^+$ wherein each R' is independently hydrogen, a $C_1$–$C_4$ alkyl or a $C_1$–$C_4$ hydroxyalkyl radical. Illustrative $C_1$–$C_4$ alkyl and hydroxyalkyl radicals include methyl, ethyl, propyl, isopropyl, butyl, hydroxymethyl and hydroxyethyl. Typical ammonium ion radicals include ammonium ($N^+H_4$), methylammonium ($CH_3N^+H_3$), ethylammonium ($C_2H_5N^+H_3$), dimethylammonium ($(CH_3)_2N^+H_2$), methylethylammonium ($CH_3N^+H_2C_2H_5$), trimethylammonium ($(CH_3)_3N^+H$), dimethylbutylammonium ($(CH_3)_2N^+HC_4H_9$), hydroxyethylammonium ($HOCH_2CH_2N^+H_3$) and methylhydroxyethylammonium ($CH_3N^+H_2CH_2CH_2OH$). Preferably, each M is hydrogen, sodium, calcium, potassium or ammonium.

Alkylated diphenyl oxide sulfonates and their methods of preparation are well-known and reference is made thereto for the purposes of this invention. Representative methods of preparation of sulfonates are disclosed in U.S. Pat. Nos. 3,264,242; 3,634,272; and 3,945,437. Commercial methods of preparation of the alkylated diphenyl oxide sulfonates generally do not produce species which are exclusively monoalkylated, monosulfonated, dialkylated or disulfonated. The commercial available species are predominantly (greater than 90 percent) disulfonated and are a mixture of mono- and dialkylated with the percentage of dialkylation being about 15 to about 25 and the percentage of monoalkylation being about 75 to 85 percent. Most typically, the commercially available species are about 80 percent monoalkylated and 20 percent dialkylated.

Two particularly preferred commercially available solutions containing alkylated diphenyl oxide sulfonate surfactants are DOWFAX® 8390 and DOWFAX® 8390A. ("DOWFAX®" is a registered trademark of The Dow Chemical Company for its brand of these anionic surfactants.) In each, the alkyl group R is predominantly a hexadecyl ($C_{16}$) group. DOWFAX® 8390A typically contains about 25 percent of the acid forms of the surfactant, that is, in which M is hydrogen. DOWFAX® 8390 typically contains about 35 percent of the sodium salts of the surfactant, that is, in which M is sodium. DOWFAX® 8390A solution fully or partially neutralized with ammonium hydroxide is also particularly preferred for supplying the anionic surfactant in the present invention.

One nonionic surfactant particularly preferred for use in the present invention is Tergitol nonionic surfactant XL-80N. ("Tergitol" is believed to be a trademark of Union Carbide Chemicals and Plastics Technology Corp., Danbury, Connecticut.) Tergitol XL-80N is a mixture of $C_8$–$C_{10}$ ethoxylated and propoxylated primary alcohols having an average molecular weight of approximately 420. The mixture decomposes rather than boils upon heating, and has a flash point of 425° F. (Cleveland open cup, ASTM D 92.218 C). It has a freezing point of −3° C., a specific gravity of 0.98 at 20° C., and is a cloudy liquid which is fully soluble in water.

Another nonionic surfactant preferred for use in the present invention is NEODOL® 91-6. ("NEODOL®" is a registered trademark of Shell Chemical Company, Geismar, Louisanna.) NEODOL® 91-6 is a detergent range mixture of $C_9$–$C_{11}$ linear primary alcohol ethoxylates having an average of 6 moles of ethylene oxide per mole of alcohol. NEODOL® 91-6 is a slightly viscous liquid having a pour point of 45° F. and a melting point of 42°–48° F. Its solubility in water is complete, although at high concentrations the product may form a gel with water. NEODOL® 91-6 contains less than 6 parts per million ethylene oxide. NEODOL® 91-6 possesses a hydroxyl number of 126–140 milligrams potassium hydroxide per gram.

Again, while these surfactants are particularly preferred for use in the present invention, others possessing a wide range of molecular weights can also be successfully employed in aqueous solution with a corrosion-inhibiting amount of a 2-piperazinone. Surfactants with linear $C_9$–$C_{11}$ carbon chains and five or six EO or PO groups are expected to be particularly useful in combination with the 2-piperazinone.

The 2-piperazinones useful in the present invention are selected from those having anticorrosive properties for the metal or other surface or finish being cleaned. 2-piperazinones having anticorrosive properties are generally expected not to detrimentally affect the dispersant activity of the surface active agent employed; however, the 2-piperazinone should of course be chosen to be compatible with the surfactant(s). The suitability of any particular combination of 2-piperazinone and surfactant can readily be determined by straightforward trial-and-error cleaning tests, for example, agitation of soiled metal samples with aqueous solutions alternatively containing and lacking a prospective surfactant or 2-piperazinone.

The 2-piperazinones useful in the present invention are the N-substituted- and N,N-disubstituted-2-piperazinones in which at least one (and, in general, preferably only one) of the substituent groups is a straight-chain alkane, alkanol or ether desirably containing from 1 to 14 carbons, and preferably containing from 1 to about 8 to 10 carbons. Any unsubstituted nitrogen will, of course, bear on it a hydrogen in place of an organic substituent group. The ether groups particularly useful as substituents are the ethylene oxide and propylene oxide derivatives.

4-(2-hydroxyethyl)-2-piperazinone (4-HEP) and N,N-dimethyl-2-piperazinone (NNDP) are especially preferred 2-piperazinones for use in the present invention. Either of these can advantageously be incorporated into a formulation of the present invention as a previously mixed 40 percent aqueous solution. The water in that solution can constitute all the water needed for compounding the cleaning formulation (or concentrate for the cleaning formulation), and the other constituents then added to it.

The water to be employed in the formulation or concentrate of the present invention should generally lack contaminants that would significantly interfere with the desired corrosion inhibition and cleaning ability. There are no other specific requirements for the quality of the water employed in the present invention. While under laboratory conditions the availability of deionized water may make the use of deionized water convenient, it is believed that it is unnecessary when making typical formulations to employ water of such high purity. To the contrary, the formulation of the present invention is operable over a wide range of water hardness, for example, that typically encountered for tap water (0–300 ppm of calcium carbonate and magnesium carbonate).

A cleaning formulation according to the present invention can optionally include a builder to enhance soil removal. The need to include a builder may be indicated if it is found that the hardness of the water used to dilute the concentrate or otherwise employed in the formulation, or that anything in the grease or oil to be removed, interferes with the dispersing activity of the selected surfactant. Most conventional builders should be acceptable, so long as they are not antagonistic to the activities of the surfactant(s) and the 2-piperazinone. Compatibility of a prospective builder with a formulation can most easily be determined by a trial-and-error test of formulations alternatively possessing and lacking the builder. Typically preferred builders would include the hydroxide, metasilicate, orthophosphate, pyrophosphate, polyphosphate and borate salts of sodium or potassium. The preferred range of concentration for a builder in the formulation would be from 1 to 10 percent, depending upon the builder selected.

A cleaning formulation according to the present invention can also include 1, 2-octanediol. 1,2-octanediol typically improves the effectiveness of the surfactant(s) to remove lithium greases and certain other soils, greases and oils. 1,2-octanediol is desirably employed at a concentration of about 1 to about 5 percent (the solubility limit of 1,2-octanediol in water), preferably at about 2.5 percent.

A concentrate useful for making a cleaning formulation under the present invention contains all of the desired constituents, suspended in water, at a concentration about 5 to 20 times greater, and preferably either at about 5 or about 10 times greater, than the concentrations preferred for use in the cleaning formulation. The concentrate can conveniently be prepared at a remote location, and then diluted with 5 to 20 volumes of water at the location of use, saving the cost of transporting the dilution water. This also allows the concentration of the resulting cleaning formulation to be tailored to the specific soils, greases and oils to be removed, since the concentration of the formulation will depend precisely on the volume of dilution water added.

It is desirable and typically advantageous to add a conventional antifoaming agent to either the formulation or the concentrate, as foaming may occur at a significant level either during agitation of the formulation during cleaning or during dilution and mixing of the concentrate. The degree of foaming depends to a great extent upon the physical method employed for cleaning or dilution. The antifoaming agent should be selected and employed at a concentration such that the detergency of the surfactant(s) and the corrosion inhibition of the 2-piperazinone are not unduly reduced. The antifoaming agent is desirably employed in the formulation at a concentration of 0.01 to 2 percent by weight, preferably at about 0.02 percent by weight. (Again, its concentration in the concentrate will be 5 to 20 times greater.) Preferred antifoaming agents include liquid silicone emulsions manufactured and sold by Dow Corning Corporation (Midland, Michigan) under its trademarks "DOW CORNING® X2-1410 ANTIFOAM" and "DOW CORNING® X2-2210 ANTIFOAM."

With regard to the method of compounding the formulation (or concentrate), it is believed that no special order or technique of mixing of the constituents is needed, since it is preferred that the constituents be fully soluble or miscible with water. The general principles governing the compounding of formulations therefore apply. Depending upon physical forms, it may be convenient to premix the 2-piperazinone and a comparable volume or weight of water. It may also be convenient to disperse the surfactant in a small quantity of water or water-miscible solvent, then mix this dispersion with the remainder of the constituents. It may also be convenient to mix any or all of the constituents with a small amount of heated water in order to facilitate dispersal in the balance of the water being employed. It can also be convenient to neutralize or partially neutralize the anionic surfactant (if present), even to as high as a relatively neutral pH (about 6 to 8) before mixing it with the other constituents. An ammonium hydroxide solution or other basic solution can be used for this purpose.

The formulation of the present invention is most advantageously employed as a solution applied to a soiled part surface and maintained at a temperature of 25°-90° C., which is then agitated in contact with the surface for a time adequate to achieve good cleaning. The parts can be mechanically agitated in a container of the cleaning formulation, or the formulation can impinge on the parts, for example, by spraying. The parts can also be submerged in the formulation and subjected to ultrasound waves.

During laboratory bench tests, an adequate agitation time for the preferred 2-piperazinones and preferred surfactants in a shaker bath was found to be typically on the order of 2-15 minutes; however, the optimal cleaning time for any particular formulation Will depend upon the amount and nature of the soil being removed, the method or equipment used for cleaning, the degree of cleaning required, and the particular surfactant and 2-piperazinone employed. For example, ultrasonic cleaning may typically require on the order of 30 seconds.

The conditions of use which are optimal for a particular formulation can be most conveniently determined on a trial-and-error basis, for example, by cleaning equally soiled sample objects such as steel coupons in formulations having varying factors such as the surfactant identity and its concentration, the 2-piperazinone identity and concentration, the builder identity and concentration, the concentrations of 1,2-octanediol and antifoaming agent, the pH, the cleaning time, the cleaning temperature, the degree of agitation and the water hardness. These are also the factors that should be taken into account in establishing an optimal cleaning process for the particular greases or oils to be cleaned.

The present invention is illustrated by the following non-limiting examples:

EXAMPLE 1

Three 1010 cold-rolled steel coupons (½ inch by 1 ½ inches by 1/16 of an inch) were precleaned for 5 minutes in 1, 1, 1-trichloroethane vapor, generated in a laboratory-scale vapor degreaser. The coupons were allowed to cool for 10 minutes and their weights were recorded. The coupons were then placed on a metal plate which had been hollowed out in the shape of a coupon. About 0.1 ±0.01 grams of Conoco HD Calcium grease were applied to the surface of each of the coupons by a tongue depressor employed as a draw down bar, to provide a smooth, even application of grease on the coupons. The coupons were reweighed to determine the precise amount of soil applied to them. The soiled coupons were then placed in a 2 ounce jar containing 50.0 milliliters of a 60° C. formulation containing 1 percent by weight Tergitol XL-80N nonionic surfactant, 1 percent by weight DOWFAX® 8390A and 1 percent by weight 4-HEP in deionized water. The jars were capped, placed into a water/shaker bath, and maintained at 60° C. while being agitated at 160 oscillations per minute for 15 minutes. The coupons were then removed from the jars and placed in 50 milliliters of deionized water at 60° C., and agitated at 160 oscillations per minute for 5 additional minutes. The coupons were removed from the jars and sprayed with cold deionized water for 10 minutes. The rinsed coupons were dried in a 100° C. oven for 10 minutes, cooled in a desiccator for 10 minutes, and weighed. The following data set forth in Table 1 were obtained:

TABLE 1

| | Coupon 1 | Coupon 2 | Coupon 3 |
|---|---|---|---|
| Initial coupon weight (g) | 8.0867 | 7.9856 | 8.0386 |
| Soiled coupon weight (g) | 8.1840 | 8.0894 | 8.1469 |
| Amount of grease applied (g) | 0.0973 | 0.1038 | 0.1083 |
| Final coupon weight (g) | 8.0867 | 7.9846 | 8.0389 |
| Amount of grease removed (g) | 0.0973 | 0.1048 | 0.1080 |
| % grease removed | 100.0 | 101.0 | 99.7 |

No corrosion of any coupon was observed to occur during cleaning with this formulation. Nor did the cleaning formulation appear to cause the deposition of any material or residue upon the coupons during cleaning. Accordingly, any amount by which a clean coupon weighed more than it weighed prior to the application of the grease was attributable only to any residual soil or grease remaining upon the coupon, not removed by cleaning. The average percentage of grease removed was 100.2 percent; in view of the precision of the balance used to weigh the coupons, this percentage can be taken as 100 percent. The aqueous mixture of nonionic and anionic surfactants with 4-HEP thus resulted in a complete cleaning of a commercial grease from the steel coupons with an aqueous solution, contrary to the recommendation of the manufacturer of the grease.

COMPARATIVE EXAMPLE 1

The same cleaning operation as disclosed in Example 1 was carried out with a cleaning formulation containing 1 percent by weight Tergitol XL-80N and 1 percent by weight DOWFX® 8390A in deionized water. The formulation thus lacked any 2-piperazinone as an anticorrosive agent. The results obtained are contained in Table 2:

TABLE 2

| | Coupon 1 | Coupon 2 | Coupon 3 |
|---|---|---|---|
| Initial coupon weight (g) | 7.8715 | 7.8858 | 7.9396 |
| Soiled coupon weight (g) | 7.9570 | 7.9961 | 8.0487 |
| Amount of grease applied (g) | 0.0855 | 0.1038 | 0.1091 |
| Final coupon weight (g) | 7.8696 | 7.8843 | 7.9403 |
| Amount of grease removed (g) | 0.0874 | 0.1118 | 0.1084 |
| % grease removed | 102.2 | 101.3 | 99.4 |

While the aqueous solution of DOWFAX® 8390A and Tergitol XL-80N appeared to adequately remove soil from the steel coupons, their use together was unacceptable because the solution caused heavy rust and corrosion to be visible on the surface of the coupons. The 2-piperazinone, in contrast, plainly permits the two surfactants to be used in combination in aqueous solution without injury to steel surfaces.

EXAMPLE 2

The cleaning method of Example 1 was carried out with a cleaning formulation of 40 percent 4-HEP in water containing 0.5 percent Tergitol XL-80N. Two different sets of coupons were cleaned at different temperatures, but otherwise the same conditions as in Example 1 were employed. 89 percent of the Conoco grease was removed at a cleaning temperature of 60° C., while 43 percent of the grease was removed at a cleaning temperature of 25° C.

COMPARATIVE EXAMPLES 2-11

For purposes of comparison with the cleaning formulations of Examples 1 and 2, as shown in Table 3 other formulations not falling within the scope of the present invention were substituted in the cleaning method of Example 1, with 15 minutes agitation at the indicated temperatures:

TABLE 3

| Comparative Example | Formulation | Temperature | % Conoco HD Calcium Grease Removed |
|---|---|---|---|
| 2 | Water | 60° C. | 14 |
| 3 | 0.5% DOWFAX® 8390A in Water | 60° C. | 18 |
| 4 | 0.5% Tergitol XL-80N in water | 60° C. | 73 |

TABLE 3-continued

| Comparative Example | Formulation | Temperature | % Conoco HD Calcium Grease Removed |
|---|---|---|---|
| 5 | 10% Oakite STC in deionized water | 60° C. | 37 |
| 6 | 10% Daraclean 282 in deionized water | 60° C. | 53 |
| 7 | 40% 4-HEP in water | 60° C.<br>25° C. | 70<br>33 |
| 8 | NMP | 60° C.<br>25° C. | 36<br>17 |
| 9 | 40% NMP in water | 25° C. | 18 |
| 10 | 0.5% Tergitol XL-80N in NMP | 60° C.<br>25° C. | 93<br>18 |
| 11 | 40% NMP and 0.5% Tergitol XL-80N in water | 60° C.<br>25° C. | 9<br>21 |

Note:
Oakite STC and Daraclean 282 are well-known conventional cleaning concentrates lacking any 2-piperazinone.

Comparative examples 9 and 11 are worthy of particular note. N-methyl-2-pyrrolidone (NMP) has been used in various alkaline and nonaqueous cleaning formulations. It is clear, however, that the inclusion of N-methyl-2-pyrrolidone in an aqueous-based surfactant solution does not yield an aqueous formulation adequate to clean a calcium grease such as Conoco HD Calcium Grease from a steel surface. While NMP and the 2-piperazinones are decidedly different materials, they do share one structural similarity (a keto oxygen in the 2-position with respect to a ring nitrogen), so that the inadequacy of NMP makes the utility of the 2-piperazinones in the present invention all the more unexpected.

EXAMPLE 3

The method of Example 1 for cleaning Conoco HD Calcium Grease from a steel surface was carried out with an aqueous cleaning formulation containing 2.5 percent DOWFAX® 8390A, 0.25 percent NEODOL® 91-6 and 1.2 percent 4-HEP, all in deionized water. The formulation was found to adequately clean the HD Calcium Grease from steel coupons under a variety of conditions of pH, cleaning time, temperature, agitation rate and water hardness. The following optimum conditions were found for the use of this formulation under laboratory conditions: pH 7.25; 8.6 minute cleaning time; 63.6° C. cleaning temperature; 164 oscillations per minute agitation rate; and 94 ppm hardness (as calcium carbonate plus magnesium carbonate).

EXAMPLE 4

The minimum concentration of 4-HEP effective to inhibit corrosion of a steel surface by an aqueous cleaning solution containing both anionic and nonionic surfactants can easily be determined. The cleaning protocol of Example 1 was carried out against Conoco HD Calcium Grease using compositions containing 1.75 percent DOWFAX® 8390, 0.25 percent Neodol® 91-6, and either 0.0, 0.4 or 1.2 percent 4-HEP in deionized water. Two trials of grease removal were conducted, and the following results obtained:

| Percent 4-HEP | Percent Grease Removal | | Visible Corrosion |
|---|---|---|---|
| | Trial 1 | Trial 2 | |
| 0.0 | 42.9 | 46.4 | Yes |
| 0.4 | 47.6 | 48.5 | Yes |

-continued

| Percent 4-HEP | Percent Grease Removal Trial 1 | Trial 2 | Visible Corrosion |
|---|---|---|---|
| 1.2 | 38.0 | 44.0 | No |

Thus, with the indicated surfactants at the stated concentrations, a corrosion-inhibiting amount of 4-HEP is between 0.4 and 1.2 percent. 0.8 percent can be presumed to be a useful estimate of the minimum corrosion-inhibiting concentration of 4-HEP under these conditions. This minimum may of course vary with the type and concentration of surfactant(s) used.

EXAMPLES 5-14

The cleaning formulations of the present invention are also useful for removing several types of greases. The greases were thought to represent the spectrum of the types of soil which may be encountered under field conditions.

More particularly, the cleaning protocol of Example 1 was carried out for 5 minutes against Conoco HD Calcium Grease, Prestige 741 AEP, and Sunquench-brand grease, with a variety of cleaning formulations. Representative formulations yielding a range of removal percentages for these greases are disclosed in Table 4, along with formulations representative of the high and low preferred concentrations of the various constituents in them:

TABLE 4

| | Formulation (percent) In Deionized Water) | | | |
|---|---|---|---|---|
| Example | 4-HEP | NEODOL ® 91-6 | DOWFAX ® 8390A | 1,2-Octanediol |
| 5 | 2.0 | 2.5 | 2.5 | 0.0 |
| 6 | 2.0 | 2.5 | 2.5 | 1.5 |
| 7 | 2.0 | 2.5 | 2.5 | 3.0 |
| 8 | 1.2 | 1.3 | 3.8 | 2.3 |
| 9 | 2.0 | 2.5 | 5.0 | 1.5 |
| 10 | 3.2 | 1.3 | 1.3 | 0.8 |
| 11 | 3.2 | 3.8 | 3.8 | 2.3 |
| 12 | 1.2 | 3.8 | 1.3 | 0.8 |
| 13 | 2.0 | 0.0 | 2.5 | 1.5 |
| 14 | 1.2 | 1.3 | 1.3 | 0.8 |

| | Grease Removal (Percent) | | |
|---|---|---|---|
| Example | Conoco HD | Prestige | Sunquench |
| 5 | 57.1 | 7.2 | 91.9 |
| 6 | 49.7 | 30.4 | 97.8 |
| 7 | 45.4 | 73.2 | 98.3 |
| 8 | 86.3 | 90.1 | 94.4 |
| 9 | 88.0 | 49.0 | 91.1 |
| 10 | 29.9 | 8.7 | 90.1 |
| 11 | 59.4 | 94.9 | 97.9 |
| 12 | 39.8 | 19.0 | 99.2 |
| 13 | 38.0 | 12.0 | 72.4 |
| 14 | 43.6 | 18.4 | 94.7 |

Note:
Example 6 represents averages of 6 samples for the percentage of grease removal.

Examples 5 through 7 show that increasing the concentration of 1,2-octanediol in the formulation can dramatically improve the effectiveness of the formulation against one type of grease (recall that the Prestige grease is a lithium-based grease) while only somewhat impairing its effectiveness against another (the Conoco HD Calcium grease). 1,2-octanediol can thus widen the spectrum of soils against which the formulation is effective.

Example 8 is a formulation having a superior combined effectiveness against these three greases.

Examples 9 and 10 are formulations representing the greatest and least effectiveness against the Conoco grease, respectively.

Examples 11 and 5 are formulations representing the greatest and least effectiveness against the Prestige grease, respectively.

Examples 12 and 13 are formulations representing the greatest and least effectiveness against the Sunquench-brand grease, respectively.

Examples 11 and 14 are formulations representing (but neither defining nor limiting) the range of concentrations particularly preferred in the practice of the present invention.

EXAMPLES 15-19

The problem of foaming during use of the formulation of the present invention can be appreciated by comparison of similar formulations alternatively lacking and containing an antifoaming agent. The formulations were prepared from a concentrate containing 12 percent 4-HEP, 2.5 percent NEODOL ® 91-6, and 25 percent DOWFAX ® 8390A (neutralized to pH 7 with aqueous ammonium hydroxide) in deionized water. Five 5.0 ml portions of the concentrate were individually placed into five thoroughly washed 100 ml graduated cylinders having ground glass stoppers. Deionized water was added to each cylinder to bring the fluid level in each to the 50.0 ml mark on them. Some foaming was encountered during this dilution of the concentrate. The cylinders were stopped and individually shaken manually for 25 strokes. The height of the foam in each was observed to be above the 100.0 ml mark immediately after shaking. After 5 minutes, the average foam height corresponded to the 76 ml level, atop an average fluid level of 47.9 ml. 1 ml of a different antifoaming agent was then added to four of the cylinders, while the last cylinder was maintained as a control, lacking an antifoaming agent. Each cylinder was again stoppered and manually shaken 25 times, and the foam heights and liquid levels set forth in Table 5 were observed:

TABLE 5

| Example | Antifoaming Agent | Initial Ht. (ml) Foam | Liquid | 5 min. Ht. (ml) Foam | Liquid |
|---|---|---|---|---|---|
| 15 | TRITON ® X-100 (blue) | >100 | ca.10 | 75 | 49 |
| 16 | TRITON ® X-100 (black) | >100 | ca.10 | 80 | 49 |
| 17 | DOW CORNING ® X2-1410 | (no foam) | 50.5 | (no foam) | 50.5 |
| 18 | DOW CORNING ® X2-2210 | (no foam) | 50.5 | (no foam) | 50.5 |
| 19 | (none) | >100 | 15 | 80 | 48 |

Note:
TRITON ® X-100 Surfactant (blue label or black label) is essentially octylphenoxypolyethoxyethanol with 1 to 3 percent polyethylene glycol. TRITON ® is a registered trademark of Rohm and Haas Company, Philadelphia, PA.

The 1 ml of DOW CORNING ® X2-1410 Antifoam was not completely dissolved in the 50 ml mixture of concentrate and deionized water.

EXAMPLES 20 and 21

The foaming tests of Examples 17 and 18 were repeated with 0.1 ml of the DOW CORNING ® X2-1410 (Example 20) and X2-2210 (Example 21) Antifoams, respectively. Each cylinder contained hardly any perceptible foam immediately after shaking (Example 21 exhibiting slightly more foam than Example 20), and no perceptible foam after 5 minutes.

EXAMPLES 22 and 23

The concentrate used to prepare the formulations of Examples 15–19 was duplicated, except that 0.2 percent DOW CORNING ® X2-1410 (Example 22) or DOW CORNING ® X2-2210 (Example 23) was included. 5 ml of each concentrate were placed individual thoroughly washed 100 ml graduated cylinders having ground glass stoppers. Deionized water was added to bring the level of fluid in each cylinder to the 50.0 ml mark. Each cylinder was shaken manually 25 times and the contents observed for foaming. While foam formed in each cylinder upon shaking, the foam disappeared rapidly (within a few seconds) after shaking was stopped.

EXAMPLES 24 and 25

The concentrate used to prepare the formulations of Examples 15–19 was duplicated, except that 0.4 percent DOW CORNING ® X2-1410 or DOW CORNING ® X2-2210 was included. Portion of each concentrate were diluted with 9 parts deionized water to part concentrate, and the resulting formulations (Examples 24 and 25, respectively) were employed to clean Conoco and Prestige greases from 1010 steel coupons. About 0.10 g of Conoco HD Calcium Grease was applied to each of four steel coupons, and about the same amount of Prestige 741 AEP was applied to each of four other steel coupons. Two coupons bearing each grease were submerged in separate 50 ml portions of each of the two cleaning formulations, and all 8 coupons were subjected to the same cleaning protocol: 15 minutes agitation in a shaker bath at 60° C. and 160 oscillations per minute, then a 10 minute deionized water rinse, followed by 10 minute drying in an oven at 100° C. and 10 minutes cooling in a desiccator. The formulation of Example 24 (containing X2-1410) removed an average of 85.7 percent of the Conoco grease and 21.7 percent of the Prestige grease. The formulation of Example 24 (containing X2-2210) removed an average of 79.3 percent of the Conoco grease and 37.1 percent of the Prestige grease. These Examples suggest that the antifoaming agent, if used, may have an appreciable influence upon the effectiveness of any particular cleaning formulation of the present invention.

EXAMPLES 26–29

As suggested by Examples 15–19 and 22–25, it may be both convenient and economical to prepare the formulations of the present invention by dilution of concentrates containing all the constituents of the formulation, but having only about 1/5 to 1/20 of the water ultimately needed in the formulation. The necessary 5 to 20 parts water can be added at a remote location, preferably the location of use of the formulation, thereby saving the portion of transportation and storage costs associated with the dilution water. The concentrates identified in Table 6 are particularly preferred for dilution in the indicated parts of water to yield useful cleaning formulations; the balance of each concentrate is deionized water, but each concentrate can be modified by including a compatible antifoaming agent, preferably at 0.2 percent in Examples 26–28 and 0.1 percent in Example 29:

TABLE 6

| | | Formulation Percent | | | | |
|---|---|---|---|---|---|---|
| Example | DOWFAX ® (Type) | Acid neutralized | NEODOL ® 91-6 | 4-HEP | 1,2-Octanediol | Preferred Dilution |
| 26 | 25 (8390) | No | 2.5 | 12 | 0.0 | 10× |
| 27 | 25 (8390A) | Yes | 2.5 | 12 | 0.0 | 10× |
| 28 | 25 (8390A) | No | 2.5 | 12 | 0.0 | 10× |
| 29 | 12.5 (8390A) | No | 1.25 | 6 | 12.5 | 5× |

EXAMPLE 30

Dilutions of various cleaner concentrates in deionized water were employed to remove a variety of greases under the same cleaning method as described in Example 1, except for a shorter (5 min.) cleaning time. (The formulation made from Example 28 was allowed a 15 minute cleaning time.) The dilutions were 1-in-10 in deionized water, except for the concentrate of Example 29, which was diluted one-in-5 in deionized water. The greases included Conoco HD Calcium Grease; Prestige 741 AEP Grease; "Sta-Lube" brand Disc Brake, Hi Temp Bearing Grease; "Sta-Lube" brand Heavy Duty Wheel Bearing Grease; and "ALEMITE CD-2", a trade name for a general purpose white lithium grease sold by Stewart-Warner Corp., Mt. Prospect, IL. The percentages of grease removed are recited in Table 7:

TABLE 7

| | Grease Removed (Percent) | | | | |
|---|---|---|---|---|---|
| Concentrate | Disc Brake | Wheel Bearing | CD-2 | Conoco | Prestige |
| Example 29 | 31 | 99 | 100 | 91 | 100 |
| Daraclean 282 | 8 | 100 | 16 | 38 | 28 |
| Oakite STC | 20 | 100 | 100 | 19 | 68 |
| Example 28 | 5 | 100 | 20 | 100 | 38 |

The formulation resulting from the one-in-5 dilution of the concentrate of Example 29 is also effective for 100 percent removal of other aged soils (Molygraph, Sunicut 462, Vacmul, Pennzdraw, Magnadraw and Sunquench) under these same cleaning conditions.

It should be evident from these Examples that the present invention achieves significant advantages over prior cleaning compositions, in that the safety and savings of cost enjoyed by water based cleaning solutions is retained, while substantial removal of greases and oils not normally subject to removal by aqueous solutions is achieved. Cleaning formulations according to the present invention are also useful to safely clean a variety of greases and oils from surfaces without damage or corrosion. The inclusion of an appropriate 2-piperazinone typically does not interfere with the dispersive activity of the selected surfactant(s), and can improve the performance of a surfactant which would otherwise be only marginally effective against selected greases and oils. This is most clearly shown by Example 2 and Comparative Example 4, in which the addition of 4-HEP to an aqueous 0.5 percent solution of Tergitol XL-80N (the 4-HEP solution providing the water in which the Tergitol is dispersed) improves its cleaning at 60° C.

from 73 percent of grease removed to 89 percent of grease removed. This augmented cleaning is achieved simultaneously with the inhibition of any corrosion experienced in the absence of the 4-HEP, for example, as experienced in Comparative Example Applicants acknowledge that in some combinations of the surfactants and the other preferred constituents in the present invention, the 2-piperazinone may decrease the effectiveness of one particular surfactant or another against any particular oil or grease. Such effects are relatively rare and do not detract from the broad applicability and success enjoyed by the present invention.

While our invention has been described in terms of several specific embodiments, it must be appreciated that other embodiments could readily be adapted by one skilled in the art. Accordingly, the scope of our invention is to be limited only by the following claims.

What is claimed is:

1. An aqueous cleaning formulation for removing grease and oil from a surface, comprising water, a surfactant possessing at least some ability to disperse the grease and oil in aqueous suspension, and a corrosion-inhibiting amount of a 2-piperazinone of the formula

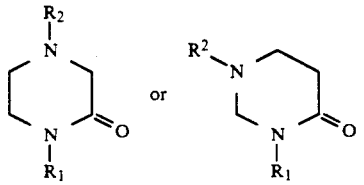

wherein $R_1$ and $R_2$ are chosen from the class consisting of H and straight-chain alkanes, alkanols and ethers containing from 1 to 14 carbons, such that $R_1$ and $R_2$ are not both H.

2. The formulation of claim 1, wherein the 2-piperazinone is 4-(2-hydroxyethyl)-2-piperazinone.

3. The formulation of claim 1, wherein the 2-piperazinone is N,N-dimethyl-2-piperazinone.

4. The formulation of claim 1, wherein the surfactant comprises an alcohol ethoxylate, propoxylate, butoxylate, ethoxybutoxylate, propoxybutoxylate, or mixture thereof.

5. The formulation of claim 1, wherein the surfactant comprises ethoxylated and propoxylated $C_8$–$C_{10}$ alcohols.

6. The formulation of claim 1, wherein the surfactant comprises an alkylated diphenyl oxide sulfonate surfactant.

7. The formulation of claim 1, wherein the surfactant comprises $C_9$–$C_{11}$ linear primary alcohol ethoxylates.

8. The formulation of claim 1, comprising both an anionic and a nonionic surfactant.

9. The formulation of claim 8, wherein the anionic surfactant comprises an alkylated diphenyl oxide sulfonate surfactant.

10. The formulation of claim 8, wherein the nonionic surfactant comprises ethoxylated and propoxylated primary $C_8$–$C_{10}$ alcohols.

11. The formulation of claim 8, wherein the nonionic surfactant comprises $C_9$–$C_{11}$ linear primary alcohol ethoxylates.

12. The formulation of claim 1, comprising 0.8 to 50 percent by weight of the 2-piperazinone, 0.05 to 10 percent by weight of a nonionic surfactant, 0.05 to 10 percent by weight of an anionic surfactant, and 20 to 80 percent by weight water.

13. The formulation of claim 1, comprising about 1.2 to 2 percent by weight 4-(2-hydroxyethyl)-2-piperazinone, about 0.5 to 0.75 percent by weight of an alkylated diphenyl oxide sulfonate surfactant, about 0.25 to 3.75 percent by weight of $C_9$–$C_{11}$ linear primary alcohol ethoxylates, and the balance, water.

14. The formulation of claim 1, comprising about 1.2 percent by weight 4-(2-hydroxyethyl)-2-piperazinone, about 0.625 percent by weight of an alkylated diphenyl oxide sulfonate surfactant, about 0.25 percent by weight of $C_9$–$C_{11}$ linear primary alcohol ethoxylates, and the balance, water.

15. The formulation of claim further comprising 1 to 10 percent by weight of a builder.

16. The formulation of claim 15, wherein the builder is a hydroxide, metasilicate, orthophosphate, pyrophosphate, polyphosphate or borate of sodium or potassium.

17. The formulation of claim further comprising 1 to 4 percent by weight 1, 2-octanediol

18. The formulation of claim 1, further comprising 0.01 to 2 percent by weight of an antifoaming agent.

19. The formulation of claim 18, Wherein the antifoaming agent is a silicone emulsion.

20. The formulation of claim 8, wherein the anionic surfactant is included as a neutral aqueous solution of the anionic surfactant having a pH between about 6 and about 8.

21. A method of removing oil and grease from a surface, comprising exposing the surface to the formulation of claim 1, for a time and at a temperature sufficient to remove sufficient oil and grease from the surface to permit subsequent processing of the surface.

22. The method of claim 21, carried out at a temperature of 25°–90° C.

23. The method of claim 21, wherein the exposing is carried out by agitation.

24. A concentrate, useful for making a formulation for removing oil and grease from a surface upon admixture of one part by weight of the concentrate in 5 to 20 parts by weight of water, comprising:

about 12 to 20 parts by weight 4-(2-hydroxyethyl)-2-piperazinone;

about 5 to 7.5 parts by weight of the sodium salt of an alkylated diphenyl oxide sulfonate surfactant;

about 2.5 to 37.5 parts by weight of a nonionic surfactant including ethoxylated and propoxylated primary $C_8$–$C_{10}$ alcohols, or $C_9$–$C_{11}$ linear primary alcohol ethoxylates; and water in an amount sufficient for suspension.

25. The concentrate of claim 24, having about 12 parts by weight of the 4-(2-hydroxyethyl)-2-piperazinone, about 6.25 parts by weight of the sulfonate surfactant, and about 2.5 parts by weight of $C_9$–$C_{11}$ linear primary alcohol ethoxylates.

26. The concentrate of claim 24, further comprising about 0.2 parts by weight of an antifoaming agent.

27. The concentrate of claim 26, wherein the antifoaming agent is a silicone emulsion.

28. A concentrate, useful for making a formulation for removing oil and grease from a surface upon admixture of one part by weight of the concentrate in 5 to 20 parts by weight of water, comprising:

about 12 parts by weight 4-(2-hydroxyethyl)-2-piperazinone;

about 5 to 7.5 parts by weight of the acid of an alkylated diphenyl oxide sulfonate surfactant;

about 2.5 to 37.5 parts by weight of a nonionic surfactant including ethoxylated and propxylated primary $C_8$–$C_{10}$ alcohols, or $C_9$–$C_{11}$ linear primary alcohol ethoxylates; and water in an amount sufficient for suspension.

29. The concentrate of claim 28, having about 6.25 parts by weight of the sulfonate surfactant, and about 2.5 parts by weight of $C_9$–$C_{11}$ linear primary alcohol ethoxylates.

30. The concentrate of claim 28, further comprising about 0.2 parts by weight of an antifoaming agent.

31. The concentrate of claim 30, wherein the antifoaming agent is a silicone emulsion.

32. A concentrate, useful for making a formulation for removing oil and grease from a surface upon admixture of one part by weight of the concentrate in 5 to 20 parts by weight of water, comprising:

about 6 parts by weight 4-(2-hydroxyethyl)-2-piperazinone;

about 2.5 to 3.75 parts by weight of the acid of an alkylated diphenyl oxide sulfonate surfactant;

about 1.25 to 18.75 parts by weight of a nonionic surfactant including ethoxylated and propoxylated primary $C_8$–$C_{10}$ alcohols, or $C_9$–$C_{11}$ linear primary alcohol ethoxylates;

about 11 to 13.5 parts by weight 1,2-octanediol; and water in an amount sufficient for suspension.

33. The concentrate of claim 32, having about 3.125 parts by weight of the sulfonate surfactant, about 1.25 parts by weight of $C_9$–$C_{11}$ linear primary alcohol ethoxylates, and about 12.5 parts by weight 1,2-octanediol.

34. The concentrate of claim 32, further comprising about 0.1 part by weight of an antifoaming agent.

35. The concentrate of claim 34, wherein the antifoaming agent is a silicone emulsion.

* * * * *

UNITED STATES PATENT AND TRADEMARK OFFICE

CERTIFICATE OF CORRECTION

PATENT NO. : 5,196,146

DATED : March 23, 1993

INVENTOR(S) : Joanna M. Farella et. al.

It is certified that error appears in the above-identified patent and that said Letters Patent is hereby corrected as shown below:

Column 18, line 15, insert --1-- between CLAIM and FURTHER.

Column 18, line 20, insert --1-- between CLAIM and FURTHER.

Signed and Sealed this

Twenty-eighth Day of December, 1993

*Attest:*

Bruce Lehman

BRUCE LEHMAN

*Attesting Officer*

*Commissioner of Patents and Trademarks*